United States Patent [19]

Hodges

[11] Patent Number: 4,597,681

[45] Date of Patent: Jul. 1, 1986

[54] ADJUSTABLE KEYBOARD

[76] Inventor: Anthony N. Hodges, 3238 Paty Dr., Honolulu, Hi. 96822

[21] Appl. No.: 561,902

[22] Filed: Dec. 15, 1983

[51] Int. Cl.[4] ..... B41J 5/10; B41J 5/12

[52] U.S. Cl. ..... 400/488; 400/489; 400/492; 200/331; 200/340

[58] Field of Search ..... 400/488, 489, 490, 492, 400/495, 472, 82, 87, 88, 682, 434.1, 479; 178/17 C; 340/365 R, 365 VL; 235/145 R, 145 A, 146; 200/331, 340

[56] References Cited

U.S. PATENT DOCUMENTS

| | | | |
|---|---|---|---|
| 213,312 | 3/1879 | Ames | 400/495 X |
| 420,566 | 2/1890 | Yost | 400/495 |
| 1,138,474 | 5/1915 | Heidner | 400/489 |
| 1,828,939 | 10/1931 | Ostrey | 400/492 |
| 2,369,807 | 2/1945 | Solon | 400/489 |
| 2,862,664 | 12/1958 | MacDonald | 235/145 R |
| 3,667,787 | 6/1972 | Semour | 400/492 X |
| 3,830,352 | 8/1974 | Kolpek | 400/682 |
| 3,902,034 | 8/1975 | Isozaki | 200/239 |
| 3,940,758 | 2/1976 | Margolin | 364/708 X |
| 3,990,565 | 11/1976 | Felton et al. | 400/83 X |
| 4,294,555 | 10/1981 | Galaske et al. | 400/488 |
| 4,378,553 | 3/1983 | McCall | 340/365 R |
| 4,509,873 | 4/1985 | Ryan | 400/489 |

FOREIGN PATENT DOCUMENTS

| | | | |
|---|---|---|---|
| 39925 | 12/1909 | Austria . | |
| 552611 | 5/1932 | Fed. Rep. of Germany . | |
| 684810 | 12/1939 | Fed. Rep. of Germany | 200/331 |
| 118120 | 9/1981 | Japan | 340/365 R |
| 8830 | 1/1982 | Japan | 340/365 R |
| 97138 | 6/1982 | Japan | 400/489 |
| 00518 | 2/1984 | PCT Int'l Appl. | 400/488 |
| 1016993 | 1/1966 | United Kingdom . | |

*Primary Examiner*—Charles A. Pearson

*Attorney, Agent, or Firm*—Gausewitz, Carr and Rothenberg

[57] ABSTRACT

An adjustable keyboard for typewriters, computers, and similar machines, is divided laterally into first and second sets of keys, with each set being adjustable about each of two mutually angulated axes so as to change the planes of the sets relative to each other and relative to the support, and also to allow each set to be angularly shifted in its own plane. The keys of each set are mounted for individual adjustment angularly, laterally, and in height. This allows the overall configuration of each set of keys to be individually adjusted for the convenience, physical, and operating characteristics of the arms, hands, and fingers of each operator.

18 Claims, 7 Drawing Figures

FIG. 1.
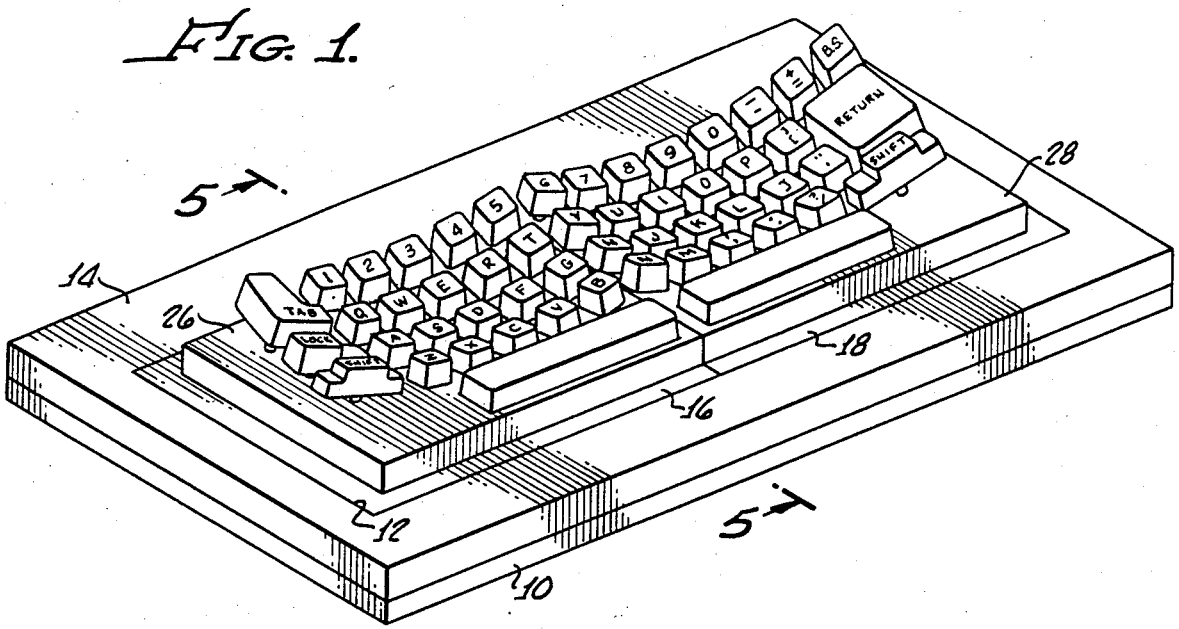
FIG. 2.
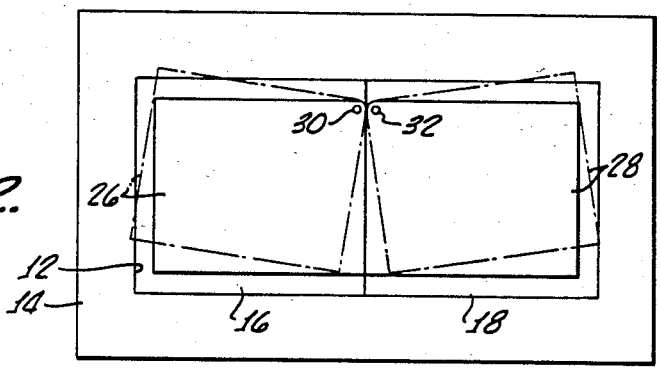
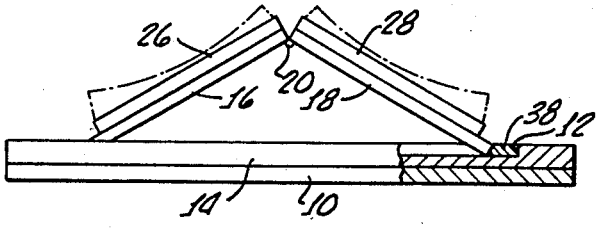
FIG. 3.
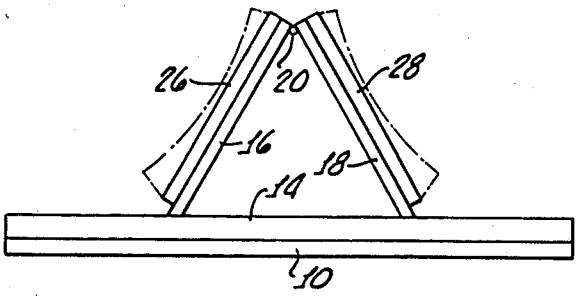
FIG. 4.

ADJUSTABLE KEYBOARD

BACKGROUND OF THE INVENTION

The present invention relates to keys and keyboards for typewriters, computers, and similar machines, and more particularly concerns such keyboards of improved convenience and individual adjustability.

A conventional keyboard of a typewriter, computer, or similar machine, has a set of keys all aligned substantially in a single plane that is somewhat tilted toward the operator. The operator's forearms are positioned at inwardly directed angles from the operator's sides toward the keyboard, with the palms down and the hands generally flat. The hands are angled outwardly relative to the forearms, so as to align the operator's fingers in directions running from the front to back of the keyboard. This is not a natural, normal or restful position for human hands. With hands extended naturally in an unstressed condition, the palms normally tend to face each other, being inclined away from the horizontal and, in some cases, closer to the vertical than horizontal position. Further, the wrists are naturally unbent and tend to align the fingers with the forearm, and not at the angle to the forearm required for typing on a conventional keyboard.

For convenience of reaching all of the keys of the keyboard, different keys should have different vertical heights and be positioned at different angles, such as to provide a generally dish-shaped surface to a keyboard. Nonuniform positioning of keys is required in part because of the difference in size and reach of different fingers of the operator's hand and the naturally different operation of the several fingers of the hand. It has been recognized that a set of keys, collectively providing a curved surface, can add to the comfort, convenience, and efficiency of keyboard operation. However, since different individuals have different physical hand structures, they require different key arrangements for maximum comfort and efficiency. Optimumly, a keyboard should be custom designed for the particular physical characteristics and typing habits of each individual operator. Such desired convenience of key set positioning and custom design of individual key sets have not been available heretofore.

Accordingly, it is an object of the present invention to provide akeyboard that minimizes or avoids such problems and provides maximized comfort, convenience, and efficiency of operation.

SUMMARY OF THE INVENTION

In carrying out principles of the present invention in accordance with a preferred embodiment thereof, first and second sets of keys that collectively form a substantially full assembly of keys are mounted on a subject for adjustable motion to change the planes of the sets relative to each other and relative to the support, and to allow the sets to shift, each in its own plane. According to another feature of the invention, each key of a group of keys is mounted for individually adjustable angular and translational motion, and each may be individually adjusted for height.

BRIEF DESCRIPTION OF THE DRAWINGS

FIG. 1 is a perspective view of a keyboard embodying principles of the present invention;

FIG. 2 is a plan view of the keyboard of FIG. 1 showing the angular adjustment of keyboard carrier sections;

FIGS. 3 and 4 are front elevational schematic views showing the keyboard with its key sets and base plates in two different positions of angular adjustment;

DETAILED DESCRIPTION OF THE INVENTION

Figure 5:
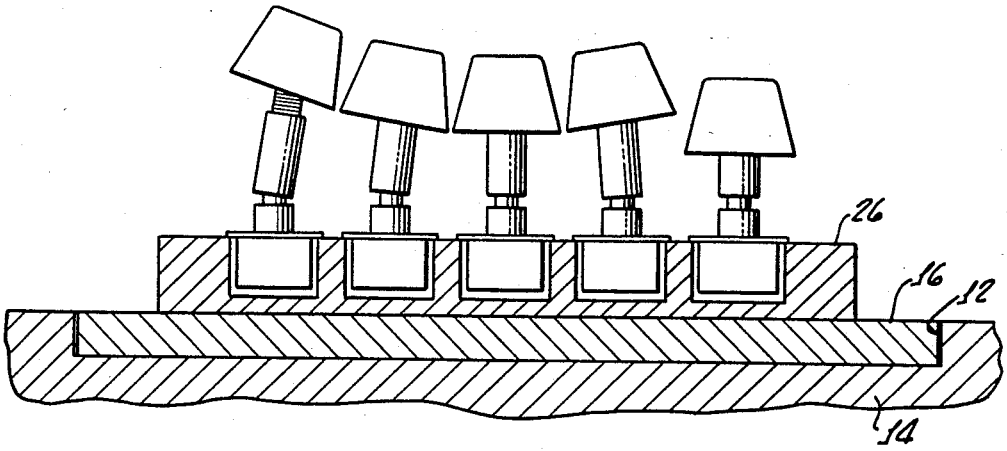
FIG. 5 is a section taken on lines 5—5 of FIG. 1.
Figure 7:
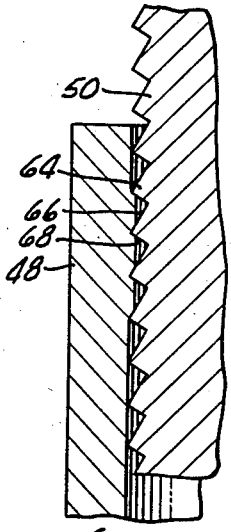
FIG. 7 is an enlarged detail of portions of the telescoping key stem.

Referring to FIG. 1, a keyboard embodying principles of the present invention is mounted upon a rigid, flat, rectangular support 10 having a shallow rectangular recess 12 formed in its upper surface 14. First and second rectangular base plates 16, 18 are mounted in side-by-side relation within the recess 12 of support 10 and substantially fill the entire area of the recess, having their upper surfaces substantially flush with the support surface 14. Base plates 16, 18 are hingedly and detachably connected to one another at adjacent lateral edges by means of a continuous detachable hinge 20 having an axis extending along the adjoining lower edges of plates 16, 18 from front to back of the keyboard. by means of hinge 20, the keyboard base plates 16 and 18 may be moved from the flat, substantially coplanar position shown in FIG. 1 to various adjusted angular positions, including those shown in FIGS. 3 and 4. In the course of this adjustment, the adjoining hinged edges are raised and one or both of the outer lateral edges are moved toward one another to thereby tilt the plane of each base plate from the horizontal toward an inclined, more nearly vertical position.

Mounted upon the base plates 16, 18 are keyboard carrier sections 26, 28, respectively, each of which is pivoted to its base plate for independent pivotal motion about an individual one of the pivot pins 30, 32, respectively. The pivot pin axes are perpendicular to the planes of the respective base plates. Thus, the respective keyboard carrier sections can swing substantially in the plane of the respective keyboard base plates about axes that extend normal to the planes of the base plates, being swingable through continuously adjustable positions including the dotted line positions illustrated in FIG. 2. The keyboard carrier sections may be held in the angular position of adjustment about axes 30, 32 by any suitable means, such as, for example, friction in the pivot pins. The carrier base plates may also be held in any desired position of adjustment by any one of a number of means that will be apparent to those skilled in the art. For example, the frictional fit of the base plates within the recess 12 of the support may be sufficient to hold the plates in position. Alternatively, a stop plate, such as plate 38, may be inserted between an outer end of one base plate and one end wall of the recess to hold the base plate in a selected upwardly angularly folded position with the outer end of the other base plate engaged with the other end wall of recess 12. Stop plate 38 may be adjustable in width or may be provided in sets of different widths to ensure retention of the base plates in any selected position of angular adjustment. If deemed necessary or desirable, a motor operated device (such as, horizontal screw and nut arrangements interconnecting lower portions of the base plates or vertically positioned piston and cylinder arrangements) may be employed for remote or power positioning of the two base plates relative to each other and to the support 10.

According to another feature of the invention, ecah key is individually mounted to its keyboard carrier section with a plurality of individual adjustments. For example, the keys may be adjusted to provide a collective dishshaped surface from front to back, as can be seen in the section of FIG. 5, and may be also adjusted to provide a lateral dish-shaped curvature, as seen in FIG. 1. Moreover, the individual keys may be shifted laterally to be closer to or further from one another, may be individually adjusted to provide desired angular positions of the tops of the keys, and may be selectively varied in height, all at the choice and convenience of the individual operator.

Figure 6:
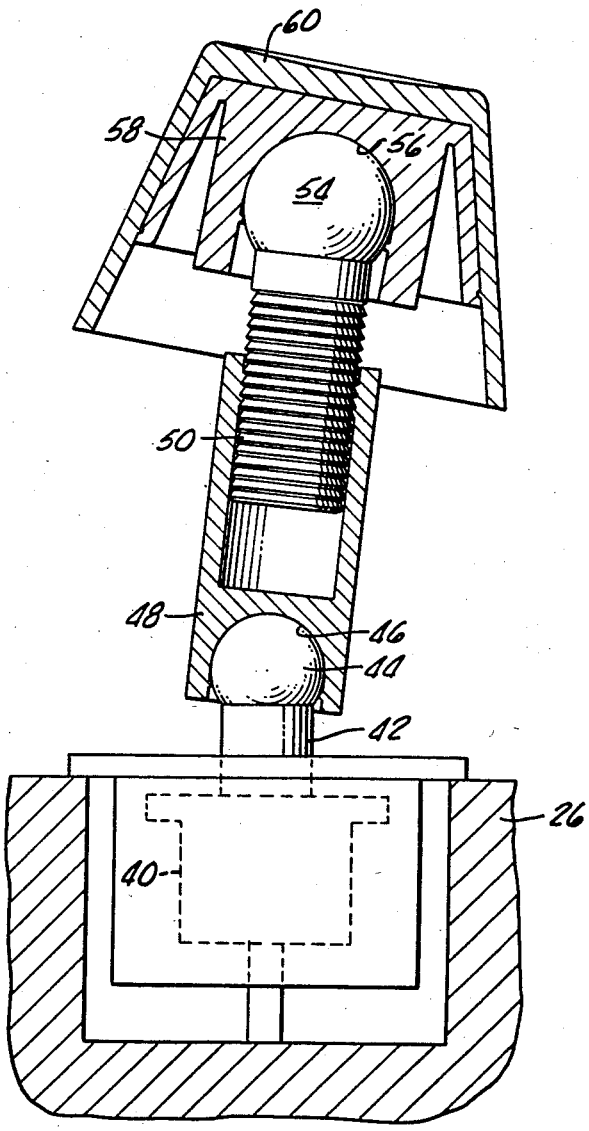
FIG. 6 is a longitudinal section through a typical key showing the structure that provides its multiple adjustability.

Details of a typical key mounting structure are illustrated in FIG. 6. A conventional electromechanical key-actuator mechanism 40 forming a key base is mounted in a conventional manner in a recess in the carrier section 26. A separate recess may be provided for each key-actuator mechanism. the conventional mechanism 40 is modified to provide a short upstanding stud 42 having a spherical connector 44 fixed to its upper end. Stud 42 may be designed to mate with different key actuator stems of existing keyboards, if deemed necessary or desirable. This will enable the adjustable keys described herein to be retrofitted to different keyboards. Connector 44 is an adjustable but tight frictional fit in a spherical connector cavity 46 formed in the lower end of a stem sleeve 48. Sleeve 48 forms the outer part of a two-part telescoping stem having an inner shaft 50 that is an adjustable, tight, frictional sliding fit within the sleeve 48. The upper end of stem 50 fixedly carries a spherical connector 54 that is an adjustable, tight, frictional fit within a spherical connector cavity 56 formed in a connecting lug 58 fixed to and within a key cap 60.

The conventional electromechanical actuating mechanism 40 includes a switch (not shown) from which electrical leads are carried from the bottom of the mechanism to the operating circuitry of the typewriter, computer, or the like, as is known to those skilled in the art.

In normal use, a pressure of approximately four ounces exerted upon the key cap 60 is transmitted through the stem to the actuator mechanism 40 and provides the desired signal that indicates actuation of each individual key. To facilitate longitudinal adjustment of the length of the key mounting stem, the two telescoping parts of the stem are arranged so as to maintain their adjusted length in the presence of the normal four ounce pressure. The frictional engagement of the stem and sleeve is chosen to require a longitudinal pressure of 8 to 10 ounces for decreasing the length of the stem. The stem is made so that lesser pressure, such as a force of six ounces, is sufficient to extend the stem by withdrawing the shaft 50 from the sleeve 48. To this end, the frictionally interengaging surfaces of the shaft 50 and sleeve 48 are arranged to have different frictional properties in two opposite longitudinal directions. The outer surface of shaft 50 is formed with a plurality of successive, continuous circular teeth 64, of which outer ends are captured in shallow grooves formed in the inner surface of the sleeve. The teeth and grooves have upper surfaces 66 at a relatively small angle to the vertical and lower surfaces 68 at a relatively larger angle. The size and angles of the teeth and shallow grooves and the resilience of the sleeve and shaft material are chosen to provide the selected resistive forces to avoid inadvertent change of key stem length. The outer ends of the teeth may bend downwardly to ride out of the grooves with relative ease as the shaft is raised to extend the length of the stem. When the shaft is pressed inwardly of the sleeve to decrease the stem length, the outer ends of the teeth 64 require greater force to be driven out of the grooves and thus provide greater resistance to contraction of the stem. If deemed necessary or desirable, the resistance to contraction and expansion of the stem may be the same, provided that this resistance is significantly greater than the force required to actuate the key, so as to prevent inadvertent change of key stem length.

It will be seen that the described key mounting arrangement enables individual adjustment of each of the keys in many different modes. The angle of the key cap 60 may be changed, its angular relation to the spherical connector 54 being retained by the frictional engagement between connector lug 58 of the key cap and the connector 54. Further, the key cap may be shifted laterally by swinging the sleeve about spherical connector 44 and also swinging the cap about the spherical connector 54 to cause the cap to remain in its same angular orientation, but shifted laterally. The described adjustments are provided by the illustrated universal joint connections and, therefore, can be made in any direction, so that each key of the keyboard may be adjusted in any direction, both angularly and translationally, so as to be positioned, as desired, by the individual operator. Each key may also be rotated, if desired, about the axis of its stem. Vertical adjustment of individual keys allows the operator to set heights of individual keys so as to custom fit the different lengths of individual fingers. Lateral adjustment in all directions allows the operator to reposition individual keys or to reposition entire rows of keys closer together or further apart, again to custom fit the keys to the size and reach of the operator's fingers and hands. Thus, keys can be moved closer together for a smaller hand and further apart for a larger hand. The angular position of the key top can also be adjusted to custom fit the angle of the key top to the actual motion of the individual operator's fingers. Having once been adjusted by one operator, the keyboard may be readily re-adjusted for use by another operator having different operating motions and different physical characteristics.

An operator, once adjusted to a conventional keyboard, may be naturally reluctant to change to a different keyboard, even though the latter is known to provide individually adjustable angular position of key sets and individually adjustable angular, lateral, and vertical positions for the individual keys. However, the described totally adjustable keyboard and key system can also be adjusted to conform substantially to an existing conventional keyboard, and may be adjusted gradually in many small steps from the conventional configuration to a configuration that is optimum for comfort, convenience, and efficiency of typing. Thus, an operator may begin use of the keyboard, such as disclosed herein, when it is adjusted to a nearly conventional configuration, and then change the keyboard configuration from time to time in slight amounts. For example, initially the two base plates, which are horizontal, may be raised only slightly, and then the angles of these base plates may be increased from time to time over a period of hours or days as each new angle becomes more familiar and comfortable to the operator. Similarly, positions of the carrier sections may be shifted a small amount at a time until an optimum position is achieved. The same step by step adjustments in small increments over a long period of time may be carried out with regard to individual key positioning, so as to provide ease of adjustment by the operator. Importantly, all adjustments are determined by what works and feels best for the individual operator, and not by some manufacturer's preconceived notion of what an average operator needs. Also, adustments may be made from time to time during a long continuous period of operation to relieve fatigue.

The two sets of keys preferably are divided so that the keys of one set include those normally operated by one hand and the keys of the other set are those normally operated by the other hand. Obviously, other modes of separation may be employed. The keys of each set are illustrated as being aligned along lines extending from front to back of the keyboard, but because of the ready adjustability, both laterally and angularly, other arrangements may be readily accomplished. Detachability of baseplates 16, 18 from one another adds even greater flexibility of position adjustment and allows the operator's arms to be at other angles.

If deemed necessary or desirable, the electromechanical actuator mechaism, instead of being mounted below the key stem at the base of the key, may be mounted within the key cap at the upper end of the stem. Such an arrangement would, in some cases, provide a more direct transmission of actuating force to the switch mechanism.

It will be seen that there has been provided an improved, fully adjustable keyboard in which positions of individual keys may be changed relative to one another, may be changed vertically, angularly, and transitionally, and in which the planes of the key sets may also be readily changed with maximum flexibility.

The foregoing detailed description is to be clearly understood as given by way of illustration and example only, the spirit and scope of this inventin being limited solely by the appended claims.

What is claimed is:

1. An adjustable keyboard for a typewriter, computer, or similar machine comprising a support having a width extending in a lateral direction and a depth extending in a transverse direction, first and second base plates positioned in side by side relation and having adjacent lateral edges hinged together for relative pivotal motion about a transverse axis, means for mounting said baseplates to said support for folding and unfolding motion between a first position wherein each said baseplate extends upwardly from said support toward its hinged edge to form an inverted V defining a relatively small included angle between the baseplates and wherein outer lateral edges of the baseplates are spaced relatively closer to one another, and a second position wherein each said baseplate has its hinged edge closer to said support and said outer lateral edges are spaced relatively further from one another to define a relatively larger included angle;

means for maintaining said baseplates in any one of a plurality of adjusted positions between said first and second positions;

first and second sets of keys on respective ones of said baseplates, said sets collectively forming a substantial full key assembly, and first and second key carrier sections each mounted to a respective one of said baseplates for pivotal motion about an individual one of a pair of axes extending substantially perpendicular to respective ones of said baseplates at adjacent rear corner portions thereof, said first and second sets of keys being respectively mounted on said carrier sections whereby each set may be adjustably positioned relative to the other about said hinged edges and about said axes.

2. The keyboard of claim 1 including means for individually, collectively, and adjustably mounting each key of a group of said keys to one of said baseplates for adjustment of the operating height of the key relative to the plane of each baseplate.

3. The keyboard of claim 1 including means for individually and adjustably mounting each key of a group of said keys to one of said baseplates for adjustment of the angular operating position of the key relative to the plane of each baseplate.

4. The keyboard of claim 1 including means for individually and adjustably mounting each key of a group of said keys to one of said baseplates for adjustment of the operating angle of the top of the key relative to the key stem and the plane of the respective baseplate.

5. The keyboard of claim 1 wherein each key of a group of said keys comprises a key base mounted on one of said baseplates, a key stem mounted on the key base for universal adjustment of position in three dimensions relative to the key base and a key top mounted on the stem for universal adjustment of operating position in three dimensions relative to the stem.

6. The keyboard of claim 1 including means for individually and adjustably mounting at least some of said keys for adjustment of the lateral operating positions of the key tops relative to the planes of said baseplates.

7. The adjustable keyboard of claim 1 including means for mounting each key of at least a group of said keys to said plates for individual adjustment in three dimensions.

8. The keyboard of claim 1 wherein each said key includes a cap, a key base, and a key stem, and a universal connection between each end of the key stem and said key base and said key cap, respectively, whereby each key is individually adjustable vertically, laterally, and angularly in three dimensions.

9. An adjustable keyboard for a typewriter, computer, or similar machine comprising a support having a width extending in a lateral direction and a depth extending in a transverse direction, first and second baseplates positioned in side by side relation and having adjacent lateral edges hinged together for relative pivotal motion about a transverse axis, means for mounting said baseplates to said support for folding and unfolding motion between a first position wherein each said baseplate extends upwardly from said support toward its hinged edge to form an inverted V defining a relatively small included angle between the baseplates and wherein outer lateral edges of the baseplates are spaced relatively closer to one another, and a second position wherein each said baseplate has its hinged edge closer to said support and said outer lateral edges are spaced relatively further from one another to define a relatively larger included angle, said mounting means including means for shiftably mounting at least one of said outer lateral edges to said support for motion toward and away from the other of said outer lateral edges, means for maintaining said baseplates in any one of a plurality of adjusted positions between said first and second positions, said baseplates in said first position and in said adjusted positions cooperating with said support to form a stable triangular structure, first and second sets of keys on respective ones of said baseplates, said sets collectively forming a substantial full key assembly, each key of a group of said keys comprising a key base mounted on one of said baseplates, and a key stem mounted on the key base for universal adjustment of position in three dimensions relative to the key base and a key top mounted on the stem for universal adjustment of operating position in three dimensions relative to the stem.

10. The keyboard of claim 9 wherein each said key stem is simultaneously adjustable in both operating length and operating angle relative to the plane of said key baseplates.

11. An adjustable keyboard comprising a support, first and second sets of keys collectively forming a substantially full assembly of keys, means for mounting said sets for adjustable motion to change the planes of the sets relative to each other and relative to the support and to shift each set in its own plane, means for mounting each key of a group of said keys for individually adjustable angular and translational motion, each said key including a key cap, said means for mounting each said key comprising a key base, a longitudinally extensible key stem, and a universal connection between each end of the key stem and said key base and key cap respectively, said longitudinally extensible stem including a key sleeve and a key shaft received within said sleeve, and means interconnecting said sleeve and shaft for providing a resistance to longitudinal extension of a first magnitude and for providing resistance to longitudinal contraction of a second magnitude greater than said first magnitude.

12. The adjustable keyboard of claim 11 wherein each said key is arranged to receive a normal actuating force of a predetermined actuating magnitude and wherein said second magnitude is greater than said actuating magnitude.

13. An adjustable keyboard comprising a support, a plurality of keys, means for mounting said keys to said support for individually adjustable angular and translational motion in three dimensions, each said key comprising a key base mounted to said support, a key stem having first and second mutually telescopic parts, said first part having a universal connection to said base, and a key cap having a universal connection to said second key stem part, said first and second key stem parts having a slidable and frictional interengagement to hold said parts in any one of a number of selected positions of longitudinal adjustment.

14. The adjustable keyboard of claim 13 wherein said keys comprise first and second sets of keys collectively forming a substantially fully assembly of keys, and wherein said means for mounting includes means for mounting said sets for adjustable motion to change the planes of the sets relative to each other and relative to the support.

15. The adjustable keyboard of claim 13 wherein said means for mounting comprises first and second base plates positioned in side by side relation and having adjacent lateral edges hinged together for relative pivotal motion about a transverse axis, means for mounting said base plates to said support for folding and unfolding motion between a first position wherein each of the plates extends upwardly from the support toward the other and toward its hinged edge and a second position wherein the plates are substantially flat upon a support, respective ones of said sets of keys being mounted respectively upon said base plates.

16. The keyboard of claim 15 wherein said base plates are detachably connected to one another.

17. The adjustable keyboard of claim 15 including first and second key carrier sections each mounted to a respective one of said base plates for shiftable motion in a plane parallel to the plane of the base plate, said sets of keys being respectively mounted on said individual ones of said key carrier sections whereby said base plates and carrier sections may be adjusted to change the planes of the sets of keys relative to each other and relative to the support and to shift each set in its own plane.

18. The adjustable keyboard of claim 13 wherein said first and second stem parts include interconnecting means for providing a resistance to longitudinal extension of a first magnitude and for providing resistance to longitudinal contraction of a second magnitude greater than said first magnitude.

* * * * *

UNITED STATES PATENT AND TRADEMARK OFFICE

CERTIFICATE OF CORRECTION

PATENT NO. : 4,597,681

DATED : Jul. 1, 1986

INVENTOR(S) : Anthony N. Hodges

It is certified that error appears in the above-identified patent and that said Letters Patent is hereby corrected as shown below:

Claim 14 (column 8, line 19), delete "fully" and substitute therefor ---full---.

Signed and Sealed this

Seventeenth Day of February, 1987

*Attest:*

DONALD J. QUIGG

*Attesting Officer*

*Commissioner of Patents and Trademarks*